US006428407B1

(12) United States Patent
Elder

(10) Patent No.: US 6,428,407 B1
(45) Date of Patent: Aug. 6, 2002

(54) COATED ABRASIVE TOOL AND CONSTRUCTION METHOD

(76) Inventor: James Tait Elder, 606 Lilly Road NE. #521, Olympia, WA (US) 98506

( * ) Notice: Subject to any disclaimer, the term of this patent is extended or adjusted under 35 U.S.C. 154(b) by 0 days.

(21) Appl. No.: 09/146,852

(22) Filed: Sep. 3, 1998

(51) Int. Cl.[7] ..... B24D 11/00

(52) U.S. Cl. ..... 451/530; 451/56; 451/529; 283/81; 283/79; 283/101; 40/630; 40/638

(58) Field of Search ..... 451/526, 529, 451/56; 283/81, 79, 101; 40/638, 630

(56) References Cited

U.S. PATENT DOCUMENTS

| | | | | | |
|---|---|---|---|---|---|
| 27,817 | A | | 4/1860 | Mayall | |
| 81,986 | A | | 9/1868 | Crane | |
| 449,930 | A | * | 4/1891 | Dubey | 451/529 |
| 492,767 | A | | 2/1893 | Acheson | |
| 615,648 | A | | 12/1898 | Acheson | |
| 1,146,359 | A | | 7/1915 | Smith | |
| 4,437,269 | A | * | 3/1984 | Shaw | 451/490 |
| 5,135,261 | A | * | 8/1992 | Cusak et al. | 285/81 |
| 5,140,785 | A | * | 8/1992 | Eleouet | 451/523 |
| 5,454,750 | A | * | 10/1995 | Cosmano et al. | 451/526 |
| 5,621,993 | A | * | 4/1997 | Stover | 40/638 |

* cited by examiner

*Primary Examiner*—Joseph J. Hail, III
*Assistant Examiner*—Shantese McDonald
(74) *Attorney, Agent, or Firm*—Brian J. Coyne

(57) ABSTRACT

A multi-grit manual finishing tool and method for making the tool. In a preferred embodiment, the tool comprises an ordered, linear sequence of pieces of coated abrasive connected by fully pliable hinges. The hinges allow virtually 360° rotation of the planes of adjacent pieces about each other, and permit the tool to accordion-fold together tightly, so that the tool becomes very compact for storage, transit and special uses. The grit sizes progressively increase from one abrasive piece to the next, thereby facilitating a choice of grit sizes within a single tool. On the non-grit surface of each piece is a distinctive labeling addition that includes indicia characterizing the grit size and abrasive nature of its corresponding grit surface. The distinctive labeling addition includes mechanical reinforcement, such as plastic, thin metal or cardboard. Each piece may abrade a work piece individually and without necessarily using any tool other than hand or fingers. By trial application to a work piece, the tool user can selectively determine from the indicia the most suitable grit sizes for finishing the piece. Methods of construction, use, and modification of such a tool are described.

16 Claims, 7 Drawing Sheets

COATED ABRASIVE TOOL AND CONSTRUCTION METHOD

CROSS REFERENCE TO RELATED INVENTIONS

None

STATEMENT REGARDING FEDERALLY APPROVED RESEARCH OR DEVELOPMENT

Not applicable.

BACKGROUND OF THE INVENTION

1. Field of the Invention

This invention relates to tools for manual finishing of surfaces using coated abrasives, particularly those that combine a variety of kinds of abrasive coatings and grit sizes within a single tool.

2. Background Art

Primitive abrasion processes used stones and loose sand for shaping and smoothing. Modern processes for finishing surfaces still employ tools with abrading materials of different fineness or abrasive nature. These tools include grinding wheels, whetstones, machinists' files, and wood rasps. Flexible versions of this class are lens-shaping grit holders, emery boards, and sheets or belts of coated abrasives.

A coated abrasive is a combination of mineral grits and a bonding material coated upon one surface of a substrate, sometimes called a backing. Usually the opposite surface of the substrate is not so coated. Manual coated abrasive finishing operations are those that do not use power tools and involve simply rubbing an abrading grit surface upon work areas that may range in size from a single edge to several square meters. Such manual operations include brief tasks, such as clearing splinters from a freshly sawed piece of wood, removing sharp edges from cut metal, and shaping fingernails, as well more elaborate tasks, such as smoothing a patched or damaged automobile paint surface and preparing furniture for application of stain, oil, or varnish.

Typically, a coated abrasive finishing process first uses a relatively coarse grit of a type specific to the work piece, followed by a similar process using at least one finer grit. Each step finer in grit size smooths scratches made by its predecessor step. Using many small steps in grit size reduces the amount of working needed with each one. There are about twenty commercially available grit sizes, covering the whole range of shaping, smoothing, and polishing. The grit size designations correspond to those used in the manufacture of grinding wheels. The American National Standards Institute maintains, under the general category B-74, definitions of standard numerical grit sizes. In other countries analogous standards have also evolved. Coated abrasive sheet descriptors may also designate methods or materials of manufacture.

Commercially packaged coated abrasives have commonly displayed the descriptive terms "coarse," "medium," and "fine." The meanings of these particular words have differed, however, for different minerals and fields of application. For example, some aluminum oxide based coatings designed for wood working have had a grit size of 120 and carry the descriptor "fine." Silicon carbide based coatings of the finer grit size 320 used for automobile finishing have been labeled "coarse." Therefore, there is a need for labels on coated abrasives that will disclose not only the grit size but the abrasive mineral content as well. Moreover, it can be a significant convenience to the user to combine several grit sizes and/or several kinds of mineral abrasive into a single manual abrasive tool; this is especially helpful for experimenting on a small portion of a work piece with various grit sizes and kinds of coated abrasives to determine the optimal combination to use.

U.S. Pat. No. 27,817, issued in 1860 to T. J. Mayall, described an abrasive sheet first formed by combining a "vulcanizable" rubber compound and grit, and adhering the combination to a backing, followed by vulcanizing the backing. This was alleged to provide an improvement over emery-cloth, emery-paper, and sand-paper.

U.S. Pat. No. 81,986, issued in 1868 to J. H. Crane, disclosed two coated abrasive sheets of different grit sizes adhered together, forming a single flexible article coated on both surfaces.

U.S. Pat. No. 357,412, issued in 1891, to E. A. Dubéy, disclosed a single sheet of "sand-paper or the like," with several different grades of abrading substance directly coated upon its substrate or backing surface in distinct sections. The coated sections were separated by narrow creases that were not coated with abrasive. Depicted in the Dubéy patent is a sheet with six such sections of identical rectangular size, folded once. This was then Z-folded to form a packet, providing a choice of different grits as the abrading face. These multiple thick folds in the packet created a versatile, unlabeled tool, but using the sheet, without folding it, was inherently clumsy. Even now, it would probably not be economic to coat uniformly the different areas as depicted in Dubéy's patent upon the same substrate or backing. Creation of uniform, high quality abrasive coatings on a mass scale usually entails a continuous-coating manufacturing process, with a controlled coating composition. Dubéy's sheet had no identification for individual grades or sizes of grit or any other identification marking. The composition and configuration of different grit sizes could not be altered by the end user. Neither the packet thickness nor the sheet size in Dubéy's sheet allowed conveniently applying force directly upon a work piece surface through only a single layer of coated abrasive. This eliminated an occasional advantage in shaping the workpiece provided in the flexible, single sheet abrasive tools disclosed by Mayall and Crane.

A three dimensional, multi-grit, coated abrasive article for manual finishing was described in U.S. Pat. No. 1,146,359 issued to W. D. Smith in 1915. It was shown as a trifoliate structure of three (or more) rectangular leaves connected along a single axis where they were joined. Each leaf had coated abrasive on both surfaces, so that all exposed surfaces were coated abrasive. The leaves folded together, and they could also be applied individually to a workpiece. Exposing the workpiece to two leaves at once was noted as an advantage, and adjacent leaf surfaces could be formed by a single folded sheet. Grit size variety was not explicitly mentioned, and there was no consideration given to grit size identification. Construction details mentioned the reinforcing effect of forming a leaf by cementing two pieces of ordinary coated abrasive paper together.

An improvement in removable abrasive and polishing sheets and pads for use with power tools was described in U.S. Pat. No. 4,437,269, issued to G. Shaw in 1984. The removable feature was achieved by adhering a textile layer with filament loops to the non-grit surface of a mass-manufactured abrasive sheet or disk. These loops were releaseably engaged by suitable hooks or stalks mounted on the tool face. A transparent adhesive was used, and the textile layer itself was selected to be sufficiently transparent to allow reading indicia already imprinted on the non-grit surface of these sheets by the coated abrasive manufacturer.

U.S. Pat. No. 5,140,785, issued to B. Eleouet, disclosed a scouring pad combination comprising several different pads of comparable but different thicknesses and attached to a flexible connecting sheet that formed hinges between the pads. In use, a packet of cleaning pads was folded into a conveniently held block through which force was applied. No provision was made for identification markings inasmuch as abrading composite or polishing material was attached to opposite surfaces of the connecting sheet.

Users of coated abrasives for manual finishing may not be experts in the many kinds of abrasives available, but they are resourceful people. Whether occasional or frequent users, they need grit variety, identification information, adaptability, predictable quality, and convenience in use and storage.

There remains a need, therefore, for an abrasive tool for manually finishing small surface areas that displays by indicia at least the grit size and abrasive mineral content. Such a tool preferably comprises reinforced, coated abrasive pieces with several grit sizes, arranged in an ordered sequence to facilitate experimentally determining the most effective grit choices for finishing a particular work piece. The tool should be easily modified, customized, shaped, or repaired, even by occasional users, and should be compact and portable. A simple and inexpensive method for making such a tool is also desirable. These needs are fulfilled by the present invention.

SUMMARY OF THE INVENTION

A multi-grit tool for manual finishing comprises coated abrasive pieces connected by fully pliable hinges that allow each piece to be applied to a work surface individually. A distinctive labeling addition to the non-grit surface of each abrasive piece includes indicia that characterize the abrasive nature of its grit surface, including at least the grit sizes and the type of mineral abrasive. The labelling addition may serve other functions as well, such as suggesting uses for the tool and displaying advertising copy. In one embodiment, the abrasive pieces are arranged in linear array, and in order of increasing grit size; in this embodiment, the tool accordion-folds into a compact packet. In an alternative embodiment, two or more pairs of hingedly-connected abrasive coated pieces are joined along a common hinge line to form a booklet. A preferred method for forming the hinges includes the step of attaching a continuous strip of transparent adhesive tape to the non-grit surfaces (directly over the distinctive labeling additions thereon) of a plurality of linearly aligned, abrasive coated pieces, such that the portions of the tape between the pieces form the hinges.

REFERENCE NUMERALS IN DRAWINGS

Figure 1:
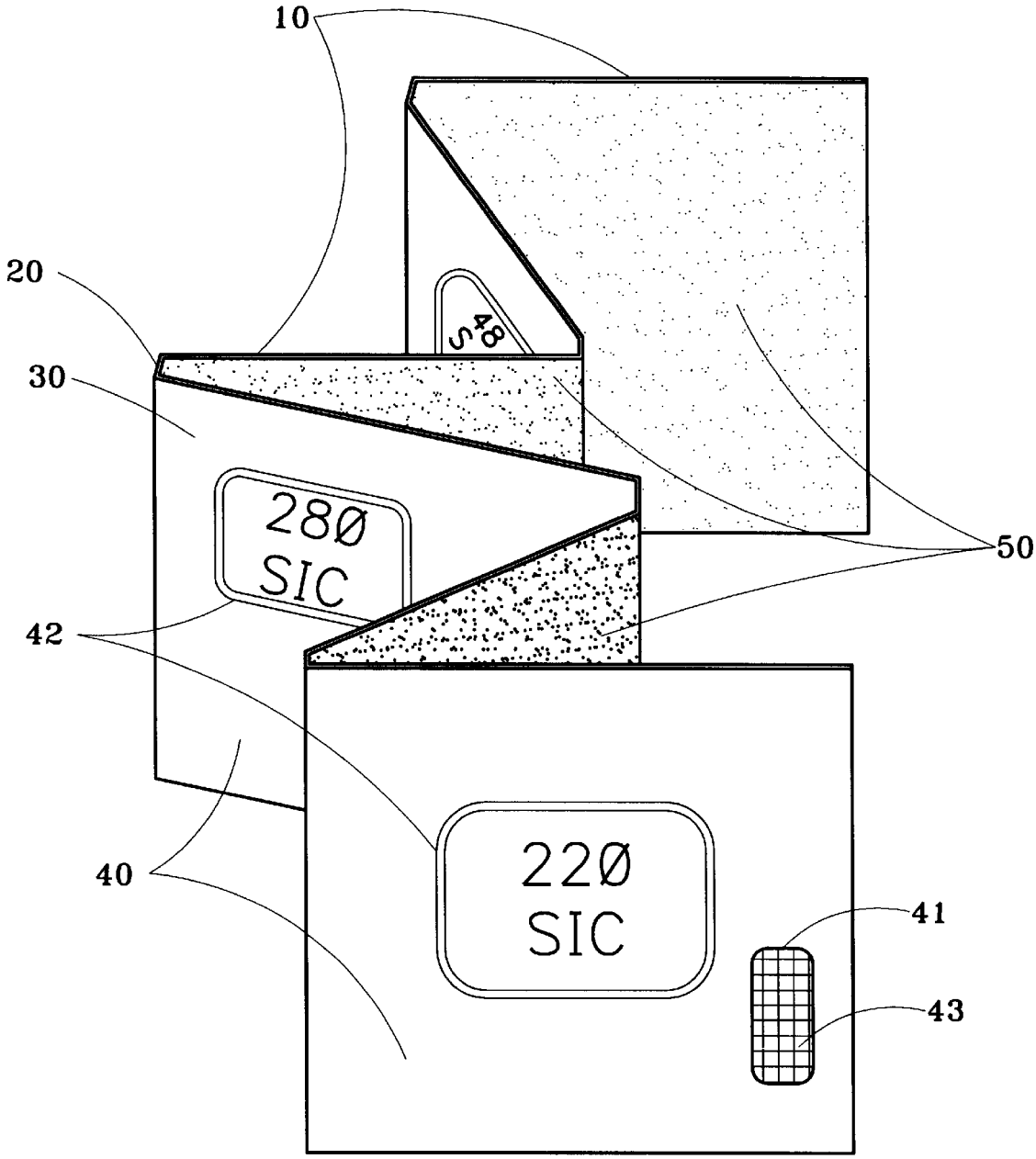
FIG. 1 is a perspective view of a multi-grit tool, partially collapsed from its full extension.

10 coated abrasive pieces of different grit size
11 material cut away for shaping area of piece
12 thin tip shaping of area
14 acute angle shaping of area
16 concave arc shaping of area
20 fully pliable hinges
22 hinge line
30 non-grit surface of coated abrasive piece
40 distinctive labeling addition to non-grit surface
41 cutaway view of surface labeling addition
42 indicia included in labeling addition
43 stiffening means
44 matrix of labeled coated abrasive sheet of same grit size
44*a* column of attached pieces of same grit size
46 six labeled columns of pieces having different grit sizes.
46*a* row of unattached pieces having different grit sizes
50 grit surface of coated abrasive pieces
60 non-abrasive informational piece
70 transparent adhesive tape binding abrasive pieces together
90 binding at hinge lines of two pair of coated abrasive pieces
90 booklet tool using two pair of hinged abrasive pieces
90*a* first pair of hinged abrasive pieces
90*b* second pair of hinged abrasive pieces

DETAILED DESCRIPTION OF THE PREFERRED EMBODIMENT

FIG. 1 shows a perspective view of one form of a multi-grit abrasive tool according to the present invention. Six pieces 10, each coated with a different abrasive, are sequentially connected in linear array by five, fully pliable hinges 20. The tool, in the embodiment depicted in FIG. 1, includes silicon carbide mineral coated paper, indicated by the label "SIC," but any of a variety of other commercially available abrasive materials can be incorporated into the tool instead. The abrasive pieces 10 are arranged such that the grit sizes monotonically increase from one end of the tool to the opposite end.

On the non-grit surface 30 of each piece 10 appear indicia 42 that characterize the abrasive nature of the corresponding grit surface 50. For each piece 10, the indicia 42 indicate at least the grit size and the type of mineral abrasive incorporated into the abrasive coating on the opposite surface of the piece 10. Optionally, the indicia 42 may display the name of the tool manufacturer and other relevant information. The indicia 42 may comprise printed or embossed letters, numbers, symbols or lines.

The indicia 42 are carried by a distinctive labeling addition 40, that overlays the entire non-grit surface 30 of the coated abrasive piece 10. In its simplest embodiment, addition 40 can consist only of minimal indicia 42 printed directly upon the non-grit surface 30. The distinctive labeling addition 40 can also include a suitable surface for labeling and an appropriate appearance and versatility for consumer use. Straight line templates included in indicia 42 could also border each piece 10 so that identical surface areas can be produced with different grit sizes. In a preferred embodiment, addition 40 also incorporates both stiffening means 43, depicted in cutway view 41 in FIG. 1, for mechanical reinforcement, and a protective coating (not shown). The stiffening means 43 is preferably plastic, thin metal or cardboard.

In FIG. 1, the tool appears as only partially collapsed along accordion-folded hinges 20, but the tool may fold tightly into a conveniently compact, thin packet for storage, transit or special uses. In use, a user extends the strip and, holding other pieces aside, applies finger or hand pressure on any one of the non-grit surfaces 30 of a piece of abrasive 10, thereby pressing and rubbing the grit surface 50 of that piece 10 against an unfinished article surface (not shown). Alternatively, the user may accordion-fold several pieces together in a packet to expose a more rigid abrasive surface. By trial, the user may determine the appropriate grit size to begin finishing a surface. Indicia 42 allow the user to determine and record that grit size for future use. Subsequent finishing with finer grit sizes can similarly help determine from indicia 42 just how many and which abrasive grit sizes will provide an acceptable finish upon a particular article. In some instances, the tool of FIG. 1 will suffice to complete the entire finishing operation. In others, the use of information that this tool provides will aid selection of particular grit sizes for subsequent finishing. A different tool of the form of FIG. 1, but having different dimensions and grit size selections from those originally used, may then be constructed. Other abrading tools having only those grit sizes found to be appropriate by use of indicia 42 may sometimes be preferable for subsequent finishing.

Figure 2A:
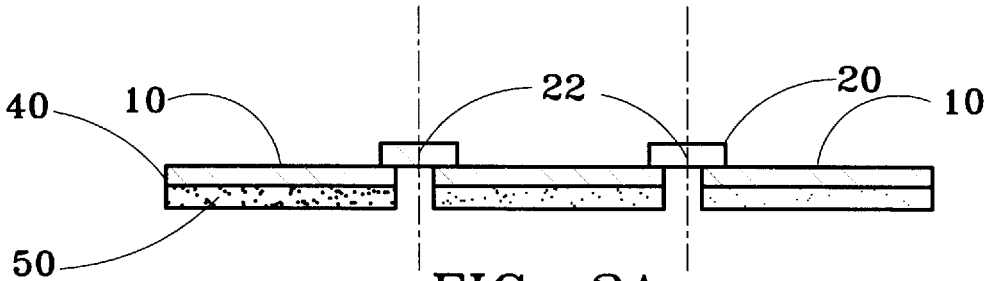
FIG. 2A shows in elevation view an elemental construction of a three-piece portion of the tool of FIG. 1.
Figure 2B:
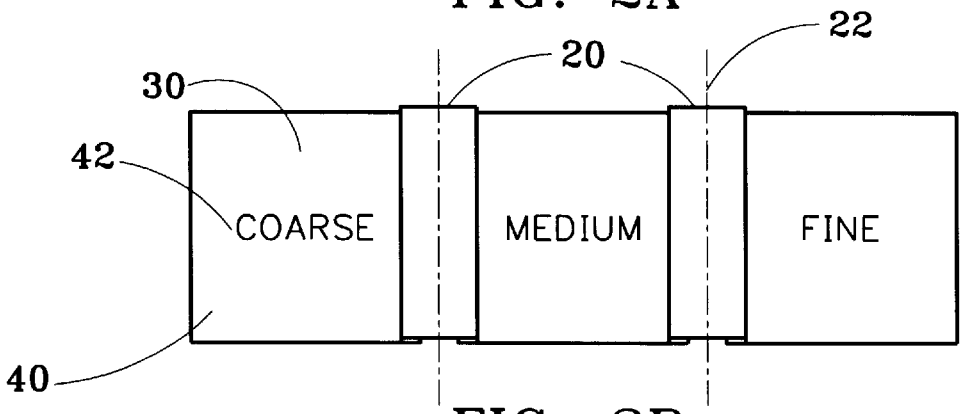
FIG. 2B and FIG. 2C show obverse and reverse plan views of this construction.
Figure 2C:
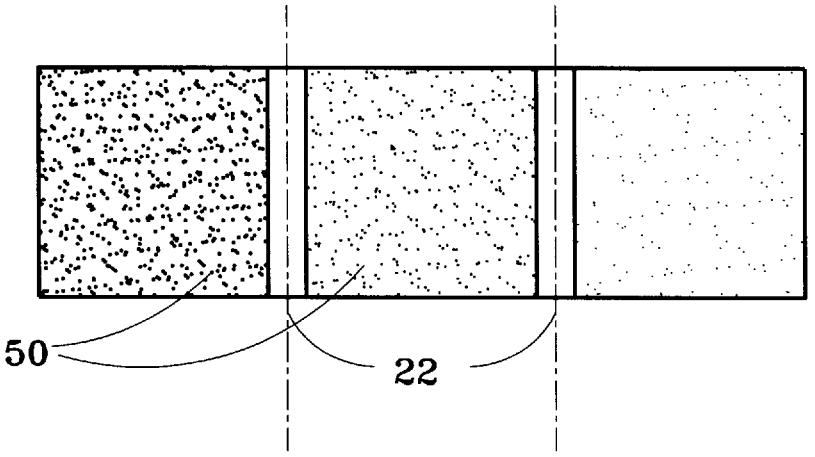

FIGS. 2A, 2B and 2C show elemental construction details of a three-piece fragment of the tool of FIG.1. FIG. 2A shows in elevation that fully pliable hinges 20 join the non-grit surfaces 30 of nearly contiguous, adjacent coated abrasive pieces 10. A fully pliable hinge is one that will enable virtually 360° of rotation of the plane of one abrasive piece 10 a hinge line 22 shared with about the plane of an adjacent abrasive piece 10 to which it is hinged. Given the resilience of the materials and the small gap between pieces, hinge line 22 (within hinge 20 and perpendicular to the paper in this view) is only approximate but functional. Also shown is the distinctive labeling addition 40.

FIG. 2B is a plan view, denoted as "obverse," of this construction, depicting the aligned, non-grit surfaces 30 thereof. The clear white background suggests that indicia 42 have been printed on some distinctive label also included in addition 40. The hinge lines 22 are also shown. The indicia 42 in FIG. 2 portray the conventional words "Coarse," "Medium," and "Fine." These words are a convenient shorthand for a few frequently used abrasives; but they are inadequate for describing precisely the grit sizes and other important abrasive features of the grit sides 50 of the pieces 10. FIG. 2C shows the "reverse" plan view, depicting the grit surfaces 50 of the abrasive pieces 10. If the coated abrasive pieces 10 exemplified by FIG. 2 incorporated the mineral aluminum oxide ($Al_2O_3$), "Fine" could be referring to either 120 or 150 grit size, and "Medium" could mean 60, 80, or 100 grit size. $Al_2O_3$ is helpful in smoothing saw cuts, rounding shelf edges and other wood finishing, and for smoothing wallboard joints.

Figure 3A:
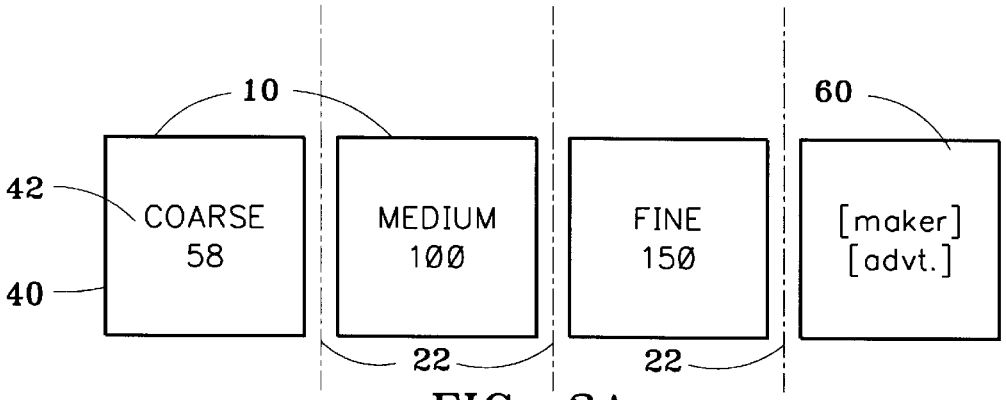
FIG. 3A and FIG. 3B show obverse and reverse plan views, respectively, of pieces of a multi-grit tool that includes a non-abrasive piece whose purpose is to provide product information.
Figure 3B:
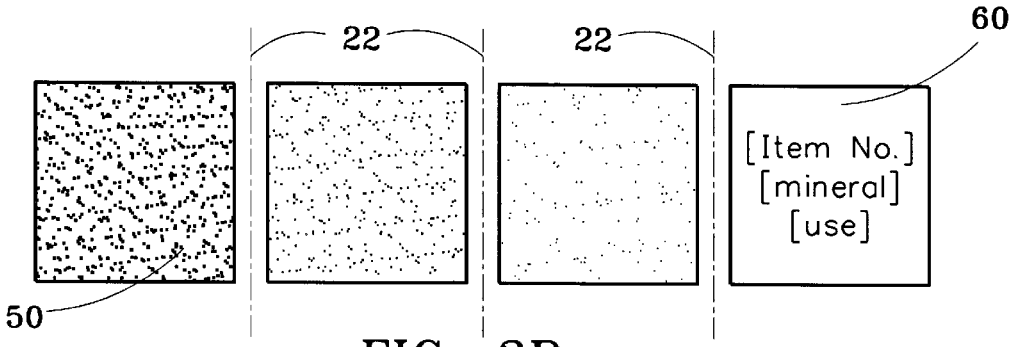
Figure 3C:
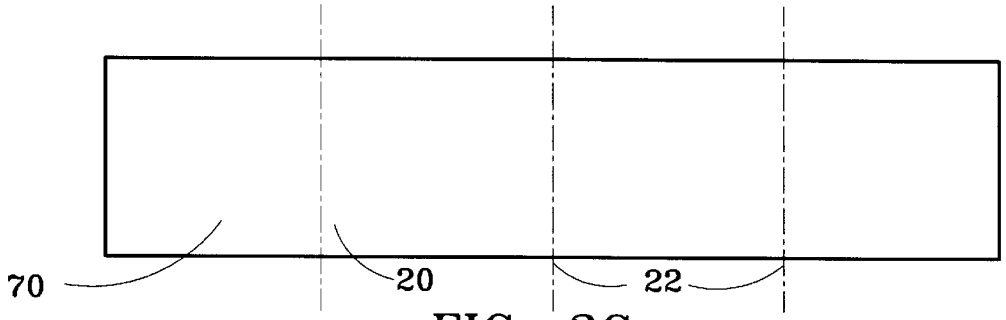
FIG. 3C shows a transparent adhesive tape overlay to join and hinge the pieces.

The tool depicted in FIGS. 3A, 3B, and 3C, resembles that of FIG. 2, but overcomes the above-described deficiency by including indicia showing the grit sizes; it also incorporates two additional features, viz.: the addition of a piece of non-abrasive material 60 into the hinged sequence, and use of a layer of transparent adhesive tape 70 as both a covering over the addition 40 and as hinge material. FIG. 3A shows in an obverse plan view three pieces 10 of coated abrasive and a non-abrasive piece 60, all aligned in linear array with respect to hinge lines 22. Illustrative detailed information is imprinted on the exposed surface of non-abrasive piece 60, including, for example, the name of the maker and advertising. FIG.3B shows in a reverse view the abrasive surfaces 50 of these same pieces, with additional illustrative information on piece 60, for example, item number, mineral abrasive, and suggested uses. The additional non-abrasive piece 60 need not be identical in shape to the other pieces. For example, it could also serve as a foldover cover if made of double width.

Figure 3D:
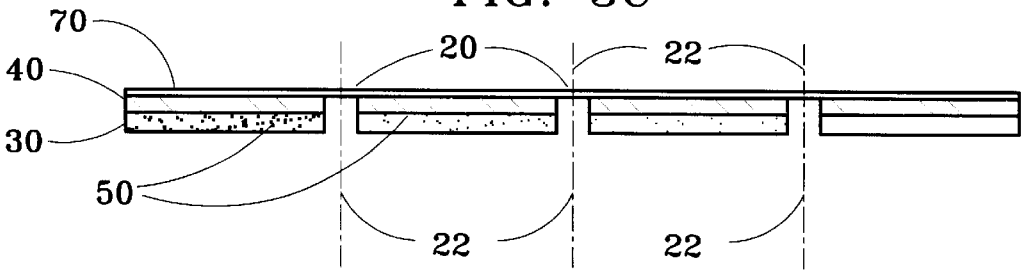
FIG. 3D shows the resulting tool in side elevation.

FIG.3C shows transparent adhesive tape 70 that completely covers the aligned pieces 10 and 60 of FIG. 3A to form a multi-grit tool, as shown in elevation view in FIG. 3D. Tape 70 overlays the distinctive labeling addition 40 attached to non-abrasive surface 30 and permits clear viewing of the indicia 42 through the tape 70. Here hinge 20 is formed by portions of tape 70 around each hinge line 22.

Figure 4:
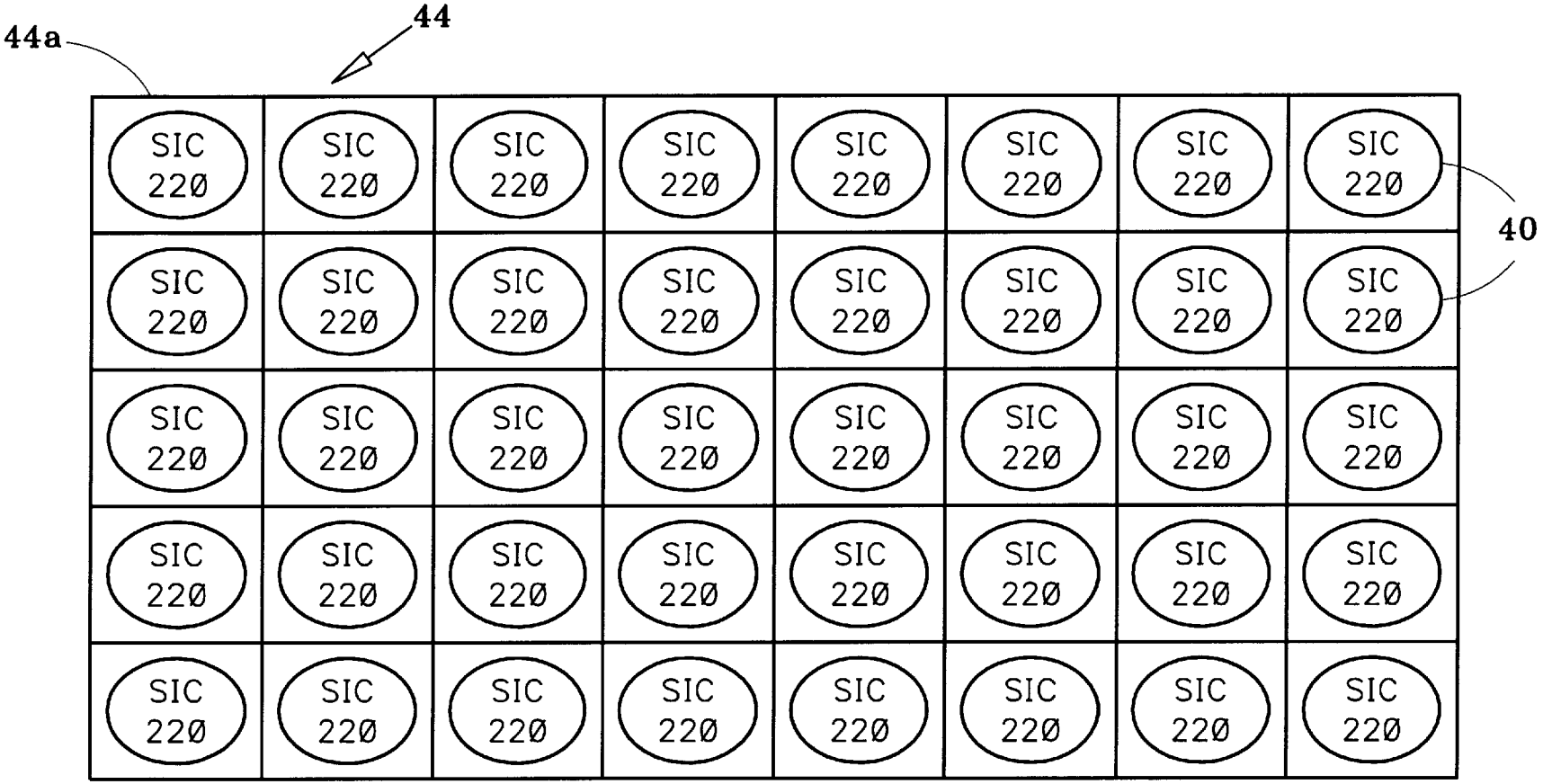
FIG. 4 shows a plan view of a sheet of coated abrasive covered on its non-grit surface with eight columns of identical rectangular patterns containing indicia characterizing its grit size. Also shown as the left column of this matrix is a connected linear array to be cut away.

A preferred method of making multi-grid tools according to the invention is depicted in FIGS. 4 and 5. FIG. 4 shows a printed piece of adhesive-coated label stock containing eight columns of small distinctive labeling additions 40 affixed to the non-grit surface of a large sheet of commercial coated abrasive 10. This matrix 44 of small areas may next be cut into linear matrix strips 44*a* as one step in making the tool of FIG. 1.

Figures 5A, 5B, 5C, 5D:
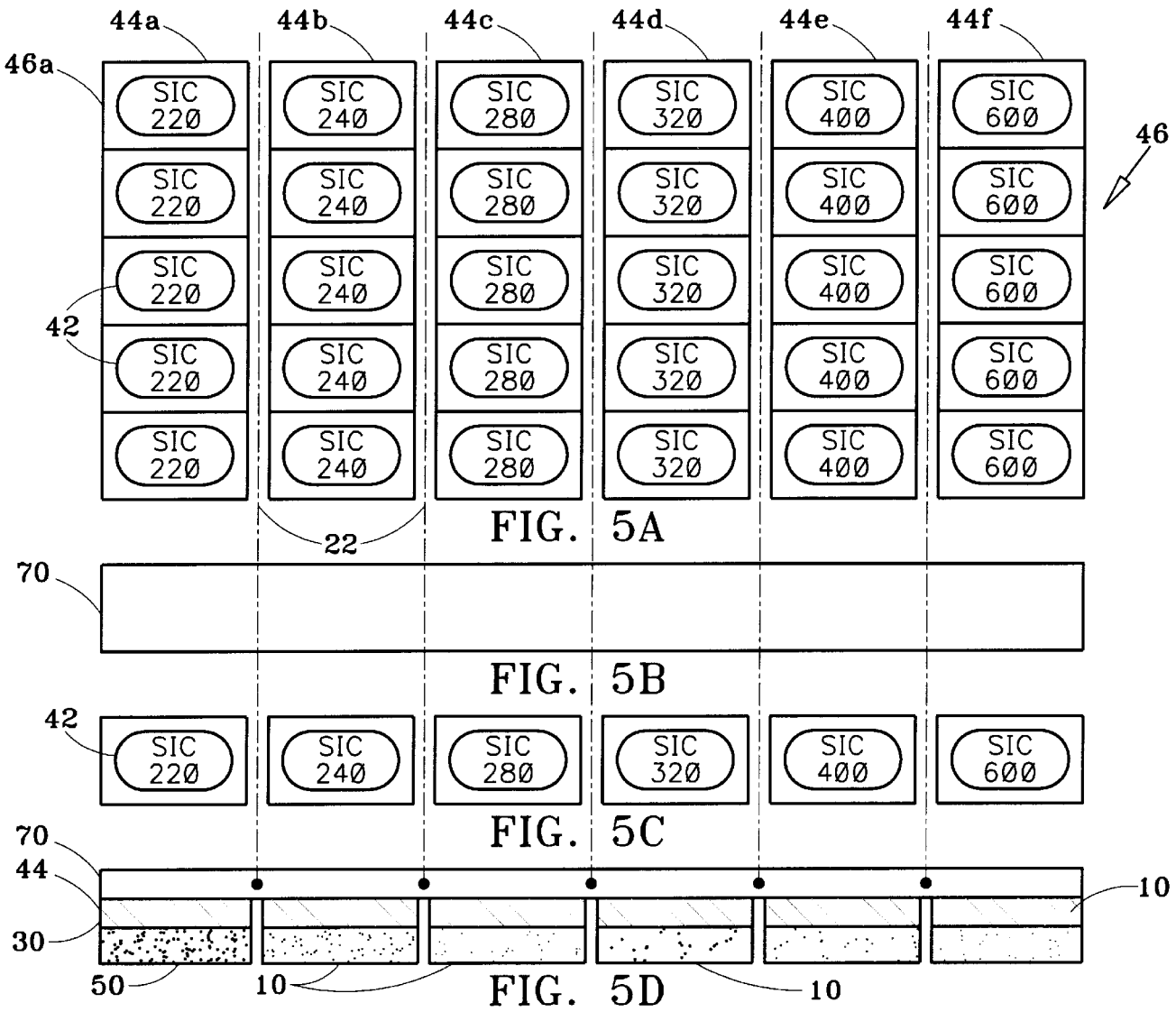
FIG. 5A shows six linear arrays of grit-identified pieces of coated abrasive aligned for tool construction.
FIG. 5B shows a piece of transparent adhesive tape to overlay and hinge together all pieces in the first row of FIG. 5A, thus forming a multi-grit tool.
FIG. 5C and FIG. 5D show this multi-grit tool in plan and elevation, respectively.

FIGS. 5A–5D show further steps in constructing five tools in one procedure. FIG. 5A shows six linear arrays of coated abrasive, called collectively 46. Each array was individually formed by first imprinting on label stock the five identical patterns for each of the grit sizes shown. These six label additions were then affixed to the non-grit surfaces 30 of six sheets of coated abrasive 10 of the designated grit size, then cut apart into the six linear arrays shown as 44*a*, 44*b*, 44*c*, 44*d*, 44*e*, and 44*f*, arranged as shown.

FIG. 5B shows a single length of transparent adhesive tape 70 of the same width as the top row 46*a* of coated abrasive pieces 10. The tape is then laid over this top row, binding them together. Cutting along the edge of the tape 70 separates a multi-grit abrasive tool, with the tape 70 serving as fully pliable hinges 22. Alternatively, one or more transparent strips 70 totaling five times the width of one row would create five such connected tools to be cut apart. Such strips may overlap. One of these tools is shown in obverse plan view in FIG. 5C and in an elevation view in FIG. 5D. The layering in FIG. 5D from top to bottom is in the following order: transparent adhesive tape 70, attached to and overlying the top surface of label additions 44 or 46*a* (which are included in distinctive label additions 40), attached to and overlying an upper surface 30 of each abrasive piece 10, attached to and overlying the grit surface 50 on the bottom. Conceivably, six continuous coating production lines could replace this process.

Figure 6A:
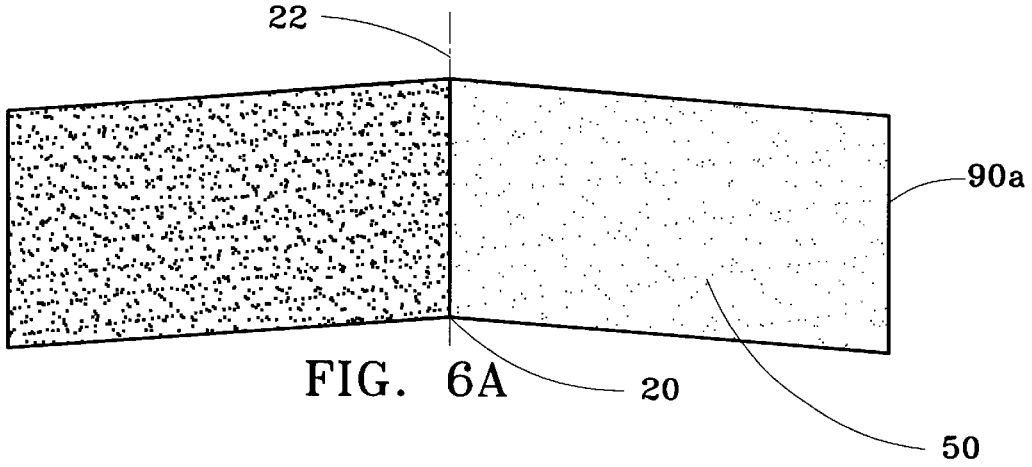
FIG. 6A is a perspective view of the abrasive surfaces of a partially folded pair of pliably hinged coated abrasive pieces.
Figure 6B:
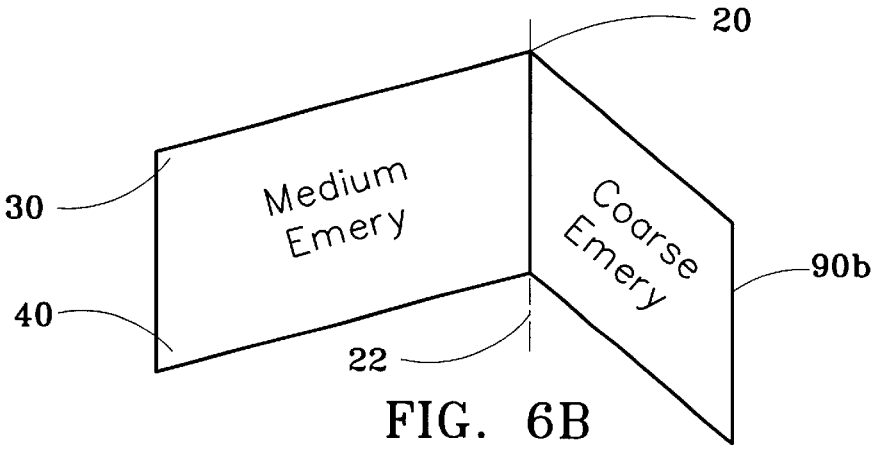
FIG. 6B shows the labeled non-grit side of a similar pair.
Figure 6C:
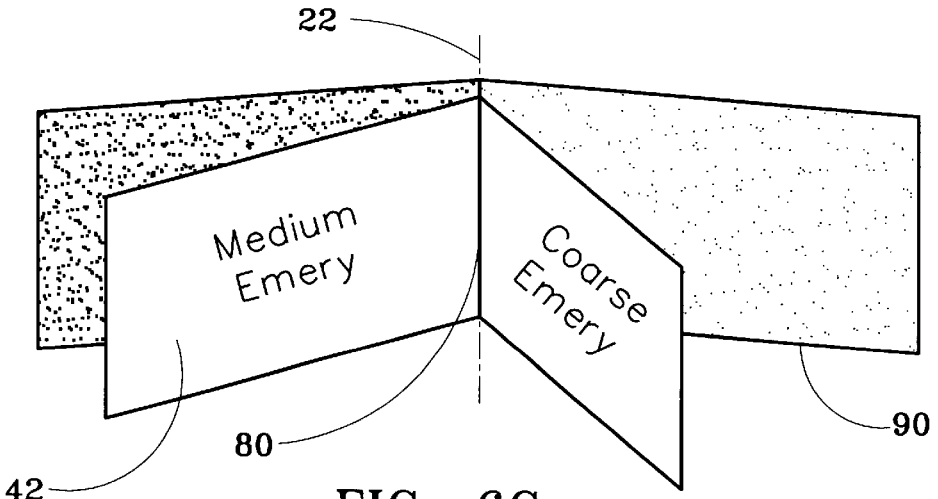
FIG. 6C shows a composite tool formed by fastening the two hinged pairs of coated abrasive pieces along their common hinge line.

FIGS. 6A–6C are perspective views of alternative embodiments of the multi-grid tool. FIG. 6A shows two, partially folded pairs of coated abrasive pieces 10, which are joined by fully pliable hinges along a hinge line 22. In FIG. 6A the abrasive surfaces 50 shown are of different grit size and form a first pair 90*a*. FIG. 6B is a similar view of the nonabrasive surfaces 30 of another pair of coated abrasive pieces 10 joined by two fully pliable hinges 20 to form a second pair 90*b*. FIG. 6C is a view of a composite tool formed by placing pair 90*a* upon the other pair 90*b* with their abrasive sides facing together. The two pairs 90*a*, 90*b*, of fully pliable hinged coated abrasive pieces 10 are then joined by staples or stitching 80 along their common hinge line 22. The coated abrasive used here, emery cloth, required a sizing coat for good adhesion as part of the distinctive labeling addition 40 that also includes indicia 42.

Figure 7:
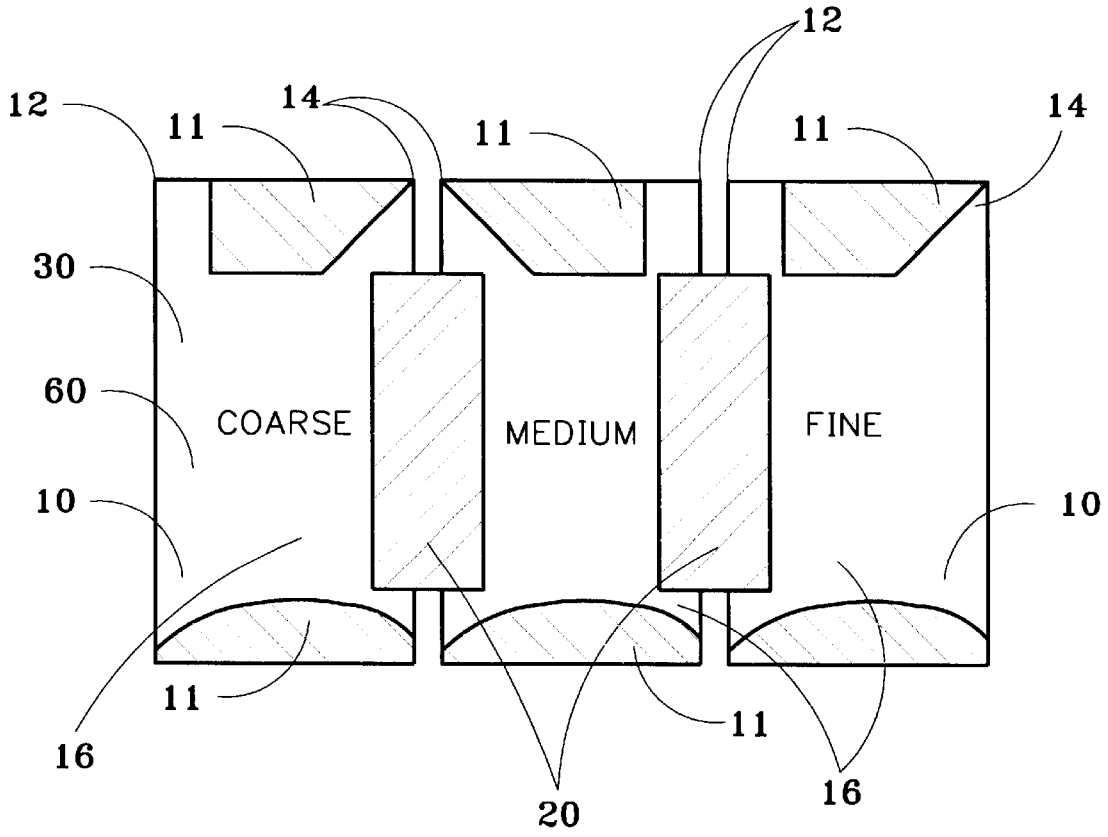
FIG. 7 shows a modification of the tool depicted in FIG. 2B in which the abrasive pieces are made longer than the hinges to allow shaping by cutting away portions of the piece areas.

FIG. 7 is a variant of the obverse plan view of FIG. 2A, in which the abrasive pieces 10 are originally cut as identical rectangles whose long side is greater than the long side of hinges 20. Shaping is accomplished with shears by cutting away areas of material 11 to form a thin rectangular shaping tip 12 on part of the coated abrasive area of piece 10. Cutting away of other abrasive material 11 leaves an acute shaping angle 14 or a concave shaping arc 16. For acute angles and narrow pieces, additional reinforcement of labeling addition 40 with stiffening means 43 may be necessary. Similar shaping of the abrasive pieces 10 in the booklet construction 90 of FIG. 6 is also possible. Such a shaped construction is more versatile for this purpose because the areas of the abrasive pieces are connected at only one hinge line 22.

The tool of this invention may be constructed entirely of commercially available materials. Relatively inexpensive coated abrasives, transparent adhesive tapes, label stock, other adhesives and sheet materials are widely available. Satisfactory hinging and assembly results are easily obtained even at supermarkets with a variety of adhesive tapes of cellophane, other plastic, fabric or strong paper. Suitable minerals for abrasive coatings include emery, garnet, aluminum oxide, silicon carbide, and diamond. These materials have traditionally addressed specific uses, often selected on the basis of cost. Since manual finishing may not require large areas of abrasive coating, performance rather than cost may be a preferred criterion.

Coated abrasives are highly sophisticated, so that their abrasive nature will depend on factors besides grit size. Silicon carbide, for example, is advantageous with soft fibrous materials as well as with tough metals. When manufactured in a form intended to be used under water, this mineral allows fingernails to be smoothed under lotion as well. The backing for the tool may be cloth or paper.

Area of Abrasive Pieces

In selecting or designing variants of this tool, the area of each individual abrasive piece is first dictated approximately by the nature of the article to be finished. Customizing the areas of abrasive pieces can allow efficient use of commercially available sizes of coated abrasive sizes. The table below shows a suggested variety of tool sizes, useful over a range of different applications.

| Common Article | Area $cm^2$ | Width cm | Length cm | Width in. | Length in. |
|---|---|---|---|---|---|
| postage stamp | 5 | 2.0 | 2.4 | 0.8 | 0.9 |
| matchbook | 15 | 3 | 5 | 1.18 | 1.96 |
| business card | 35 | 4.6 | 7.6 | 1.81 | 3 |
| kitchen sponge | 96 | 7.6 | 12.7 | 3 | 5 |
| emery cloth | 158 | 10.0 | 15.8 | 3.9 | 6.2 |
| sanding block | 213 | 9.3 | 22.9 | 3.7 | 9.0 |
| full sandpaper | 639 | 22.9 | 27.9 | 9.0 | 11.0 |

Postage stamp size areas of abrasive pieces, providing many grit sizes in a small volume, work with single-finger pressure. This is usually a large enough surface area to test abrasiveness in selecting the right grit size for a particular finishing task. The same tool may be used successively on quite different workpieces. This size allows quick, inexpensive trial before beginning a finishing job. Even smaller sizes may be used with very expensive materials such as diamond grits. Smaller sizes may also be simulated by shaping as shown in FIG. 7. A pencil eraser may be more convenient to apply pressure, or a workpiece edge may be rubbed or honed against the tool held on a table top.

Many applications need no more than the stamp size area tool for completion. For fingernail edge shaping and smoothing, a few grades found to be effective in a particular instance may be selected from the many grades available on a tool. Similar benefits of small area finishing arise in smoothing the bottoms of ceramic articles, healing flaws in automobile paint repairs, or reworking damaged spots on furniture.

For larger areas or multi-finger application of pressure, the matchbook or business card size may be more helpful. These are also useful sizes for advertising. The multi-grid tool as described herein can exemplify in use an entire coated abrasive product line, inexpensively, within a single tool—which suggests its use for marketing abrasives. A complete array of grit grades is a valuable sales aid, whether as demonstration kit, promotional gift, or trial purchase. Larger sizes lend themselves to displaying more detailed information or advertising. For tools having sponge size area, all fingers or the palm may be used. These sizes may also benefit from some ancillary pressing aid, such as a block of wood.

Thus, while the preferred embodiments of the invention have been illustrated and described, it is accordingly intended that the disclosure be taken as illustrative only, and that the scope of the invention be defined by the following claims.

I claim:

1. A coated abrasive tool for manual treatment of surfaces, comprising a first coated abrasive piece, said coated abrasive piece including:

a distinctive labelling addition having a first, nongrit surface and a second, opposite surface coated with grit;

indicia on said first surface indicating at least the grit size and mineral designation of said grit;

stiffening means incorporated within said addition, said stiffening means chosen from one or more of cardboard, plastic or thin metal;

a second abrasive piece identical to the first abrasive piece, except for being coated with grit of a different grit size than that of the first abrasive piece, and disposed adjacent to the first abrasive piece; and a fully pliable hinge; wherein the first and second abrasive pieces are joined by said hinge along a hinge line between said pieces.

2. The tool of claim 1, further comprising a continuous strip of transparent adhesive tape extending across and between said nongrit surfaces, thereby forming said hinge.

3. A coated abrasive tool for manual treatment of surfaces, comprising:

a plurality of abrasive pieces disposed in a linear array, each abrasive piece including a distinctive labelling addition having a first, nongrit surface and a second, opposite surface coated with grit;

indicia on said first surface indicating at least the grit size and the mineral designation of said grit;

stiffening means incorporated within said addition; and a fully pliable hinge disposed between, and attached to, adjacent abrasive pieces; wherein the grit sizes progressively increase along said array from one abrasive piece to the next.

4. The tool of claim 3, wherein the stiffening means comprises cardboard.

5. The tool of claim 3, wherein the stiffening means comprises plastic.

6. The tool of claim 3, wherein the stiffening means comprises thin metal.

7. The tool of claim 3, 4, 5, or 6, further comprising a continuous strip of transparent adhesive tape extending across and between said nongrit surfaces, thereby forming said hinge.

8. A coated abrasive tool for manual treatment of surfaces, comprising first and second pairs of coated abrasive pieces joined along a common hinge line, each pair of pieces within each pair being connected by a fully pliable hinge along said common hinge line, and each piece of each pair including:

a distinctive labelling addition having a first, nongrit surface and a second, opposite surface coated with grit;

indicia on said first surface indicating at least the grit size and mineral designation of said grit; and stiffening means incorporated within said addition; wherein the grit size of each piece differs from the grit size of the other pieces.

9. The tool of claim 8, further comprising a continuous strip of transparent adhesive tape extending across and between said nongrit surfaces, thereby forming said hinge.

10. The tool of claim 9, wherein the stiffening means comprises cardboard.

11. The tool of claim 9, wherein the stiffening means comprises plastic.

12. The tool of claim 11, wherein the stiffening means comprises thin metal.

13. A method for making m abrasive coated tools for manual treatment of surfaces, said tools each being coated with a selected mineral abrasive and each comprising n coated abrasive pieces hingedly joined in linear array in ascending order of grit sizes, comprising the steps of:

(a) stiffening n rectangular sheets of label stock with stiffening means;

(b) defining, on a first side of said sheets of label stock, n columns of uniform width and, normal thereto, m rows of uniform height, thereby defining n by m rectangular spaces thereon;

(c) applying indicia to said first side of said sheets of label stock within each of said n by m rectangular spaces thereon, said indicia indicating for each said sheet one of the n grit sizes of the selected abrasive mineral within each said rectangular space, for each of said m rows;

(d) attaching to a second, opposite side of each of the n sheets of indicia-bearing label stock formed in step (c) one of an assortment of n abrasive coated sheets having n different grit sizes, such that said second side of each of said n sheets bears said selected mineral abrasive of grit size equal to the grit size indicated on said first side of said sheet, thereby forming n sheets of indicia and grit bearing label stock;

(e) cutting said indicia and grit bearing sheets formed in step (d) to separate the n columns on each said sheet to form n columnar strips;

(f) placing the n columnar stips formed in step (e) adjacent and parallel to each other such that the indicia thereon are aligned to form a matrix of n columns by m rows, and such that the indicia indicate n sequentially increasing grit sizes across each of the m rows;

(g) applying transparent adhesive tape to the first, indicia-bearing side of each of the indicia and grit bearing sheets of the matrix formed in step (f), such that said tape extends across all m rows and n columns thereof;

(h) cutting apart the m rows of the taped matrix formed in step (g) to form m tools, wherein each tool comprises n abrasive-coated peices hingedly joined by said tape.

14. The method of claim 13, wherein the stiffening means comprises cardboard.

15. The method of claim 13, wherein the stiffening means comprises plastic.

16. The method of claim 13, wherein the stiffening means comprises thin metal.

* * * * *